United States Patent [19]

Norman et al.

[11] 4,183,362

[45] Jan. 15, 1980

[54] DECREASING THE BURN RATE OF SMOKING TOBACCOS

[75] Inventors: Vello Norman, Raleigh; Henry Moore, Durham; Thomas B. Williams, Durham, all of N.C.

[73] Assignee: Liggett Group Inc., Montvale, N.J.

[21] Appl. No.: 877,583

[22] Filed: Feb. 13, 1978

Related U.S. Application Data

[63] Continuation-in-part of Ser. No. 680,637, Apr. 22, 1976, abandoned, which is a continuation of Ser. No. 501,763, Aug. 29, 1974, abandoned.

[51] Int. Cl.[2] ..... A24B 15/00; A24B 15/02; A24B 15/04; A24D 1/00

[52] U.S. Cl. ..... 131/9; 131/17 R; 131/17 A; 131/140 R; 131/140 C

[58] Field of Search ..... 131/2, 17, 8, 9

[56] References Cited

U.S. PATENT DOCUMENTS

| | | | |
|---|---|---|---|
| 2,429,567 | 10/1947 | Sowa | 131/174 X |
| 2,586,701 | 2/1952 | Norton | 131/17 R |
| 3,034,932 | 5/1962 | Donovan et al. | 131/17 R |
| 3,628,541 | 12/1971 | Buchmann | 131/140 C |

OTHER PUBLICATIONS

*Ber Inst. Tabakforsch.*, Dresden, by Pyriki et al., vol. 2, pp. 94–111, Jun. 9, 1967.

*Primary Examiner*—V. Millin
*Attorney, Agent, or Firm*—J. Bowen Ross, Jr.; Michael L. Hendershot

[57] ABSTRACT

The burn rate of tobacco is decreased without impairment of its quality of smoking by the application thereto of small amounts of certain salts, preferably hydrated magnesium chloride, which upon heating exhibit a plurality of endothermic reactions at successively increasing temperatures in the range from about 100° C. to about 500° C. In addition, the presence of small amounts of an alkaline material such as calcium hydroxide is desired to counteract marginal changes in the yields of some smoke components and to increase smoke pH.

15 Claims, 2 Drawing Figures

DECREASING THE BURN RATE OF SMOKING TOBACCOS

This application is a continuation-in-part of abandoned U.S. application, Ser. No. 680,637, filed Apr. 22, 1976 which in turn is a continuation of abandoned U.S. application Ser. No. 501,763, filed Aug. 29, 1974.

FIELD OF THE INVENTION

This invention relates to smoking tobacco and more especially to tobacco prepared for smoking in a cigarette and to cigarettes.

BACKGROUND OF THE INVENTION

During recent years there has been a trend in the cigarette industry towards lower yields of "tar" and nicotine. This has frequently been accomplished by increasing the filling power of the tobacco, namely, by putting less tobacco in the cigarette or by using more porous and/or faster burning cigarette papers. As a result of these measures the number of standard puffs obtainable from a cigarette has become reduced to the point that the cigarette burn rate is sometimes unacceptable to the consumer. It would be desirable, therefore, to reduce the cigarette burn rate while at the same time maintaining the above-mentioned benefits that were accrued before the burn rate was increased.

Various inorganic salts have been noted as promotors or as retardants of combustion in a variety of applications. Possible applicability to a cigarette is, however, subject to a number of restrictive requirements. Thus, any cigarette additive must be something which is easily applicable to tobacco and which exercises a significant effect at a low level consistent with its inclusion in a product such as a cigarette. Furthermore, neither the additive nor its decomposition products should be present in smoke in any amount inconsistent with commercial acceptability. Thus, the additive and its decomposition products should be present in smoke only at physiologically innocuous amounts. The additives should have relatively little effect on the yield of the various smoke components or, if there is any effect, it should be in a desirable direction. Of course, the additive should have a negligible adverse effect on taste. Another requirement is that any additive must be low in humectant properties so that at high relative humidities, e.g., above 60%, the treated tobacco does not absorb excessive amounts of moisture.

The burn rate of cigarettes is generally expressed quantitatively in one or more of three ways. One quantitative measurement consists in ascertaining the number of puffs obtainable from a given cigarette under the standard smoking regime wherein 2 second 35 cc puffs are taken once a minute to a butt length of 23 mm for non-filter cigarettes or tipping length plus 3 mm for filter cigarettes. Burn rate also may be quantitatively indicated by measuring the rate, expressed in mm/min, at which the tobacco column of the cigarette burns under free burning conditions. This measurement ordinarily is referred to as the linear burn rate. The third measurement, which is independent of tobacco packing density, is the mass burn rate. It is expressed in mg/min and calculated from the linear burn rate (LBR) and tobacco density according to the formula:

Mass Burn Rate =

-continued $$LBR\ (\text{mm/min}) \times \frac{\text{tobacco weight (mg)}}{\text{tobacco Rod length (mm)}}$$

A tobacco is to be regarded as having a decreased burn rate, as this term is used herein and in the claims, if it exhibits decreased burn rate when measured by any one or more of these procedures.

GENERAL DESCRIPTION OF INVENTION

According to this invention, the burn rate of smoking tobacco, and more especially the burn rate of smoking tobacco which has been prepared for use in cigarettes, may be effectively decreased by the inclusion in the tobacco of a small quantity of a salt, preferably hydrated magnesium chloride, which when heated from ambient to burning temperature exhibits a plurality of endothermic reactions at successively increasing temperatures in the range from about 100° to 500° C. It is a principal aspect of this invention that the burn rate of tobacco can thus be substantialy reduced while at the same time meeting all of the requirements hereinabove mentioned for inclusion in a product such as a cigarette.

FIGS. 1 and 2 represent endothermic activity of the salts hydrated magnesium chloride and hydrated calcium chloride.

The endothermic activity of the salt may be determined in any suitable fashion, such as by differential thermal analysis. The tracing obtained by such analysis of hydrated magnesium chloride ($MgCl_2.6H_2O$) is shown in FIG. 1, from which it can be seen that five endothermic events occurred in the range of 100° to 500° C. By contrast, the tracing obtained by analysis of hydrated calcium chloride ($CaCl_2.6H_2O$), which is shown in FIG. 2, evidences only one such event at the low temperature of about 140° C. Hydrated calcium chloride is not effective in reducing tobacco burn rate.

Compounds which have been found effective in reducing tobacco burn rate are hydrates of chloride or sulfate salts, are citrate salts, or are hydrates of citrate salts which have the above-mentioned endothermic behavior. Suitable compounds include hydrated magnesium chloride ($MgCl_2.6H_2O$), ferrous ammonium citrate, hydrated ferric chloride ($FeCl_3.6H_2O$), hydrated ferric sulfate ($Fe(SO_4)_3.9H_2O$), magnesium hydrogen citrate, hydrated sodium citrate ($Na_3Cit.2H_2$), where "Cit" designates the citrate moiety), and hydrated potassium aluminum sulfate ($KAl(SO_4)_2.12H_2O$) or potassium alum. Hydrated magnesium chloride is preferred because both magnesium and chloride are indigenous to tobacco, and magnesium compounds are generally classed as rather innocuous physiologically. Accordingly, although specific reference will be made below to hydrated magnesium chloride, it should be understood that other salts possessing similar endothermic behavior may be employed in like manner.

Hydrated magnesium chloride may be readily applied to the tobacco in the form of a solution in a suitable volatile solvent such as water or ethyl alcohol. The quantity of hydrated magnesium chloride which is required in order to provide effective decrease in burn rate is small. Thus, it has been found that hydrated magnesium chloride is effective to substantially reduce burn rate when the weight of the hydrated magnesium chloride, calculated as $MgCl_2$, is in the range from about 0.1% to 5.0% on the basis of the combined weight of the tobacco and the magnesium chloride additive. The preferred range is 0.75 to 1.5%. Analyses of the smoke produced upon burning a cigarette containing hydrated magnesium chloride at levels of the order above-mentioned have indicated that its contribution to the smoke is physiologically innocuous and that there is little effect on the yield of the various smoke components which ordinarily occur. Taste effects are negligible. When magnesium chloride is incorporated as an additive the humectant properties of the tobacco are only marginally affected.

When smoking a cigarette wherein magnesium chloride additive has been applied to the tobacco in the form of a solution of $MgCl_2.6H_2O$, the magnesium chloride becomes heated from ambient temperature to the temperature of the burning cigarette cone which is of the order to 900° C. It is believed that the endothermic effects evidenced by FIG. 1 are responsible for slowing the burn rate by removing heat from the tobacco as it is being brought to the burning temperature of the cone. Endothermic reactions involved in the decomposition of the salt and sometimes the reaction of the decomposition products with the water of hydration which usually takes place over an extended temperature range are believed to be the most important factors contributing to the effectiveness of the additive.

DETAILED DESCRIPTION OF THE INVENTION

Figure 1:
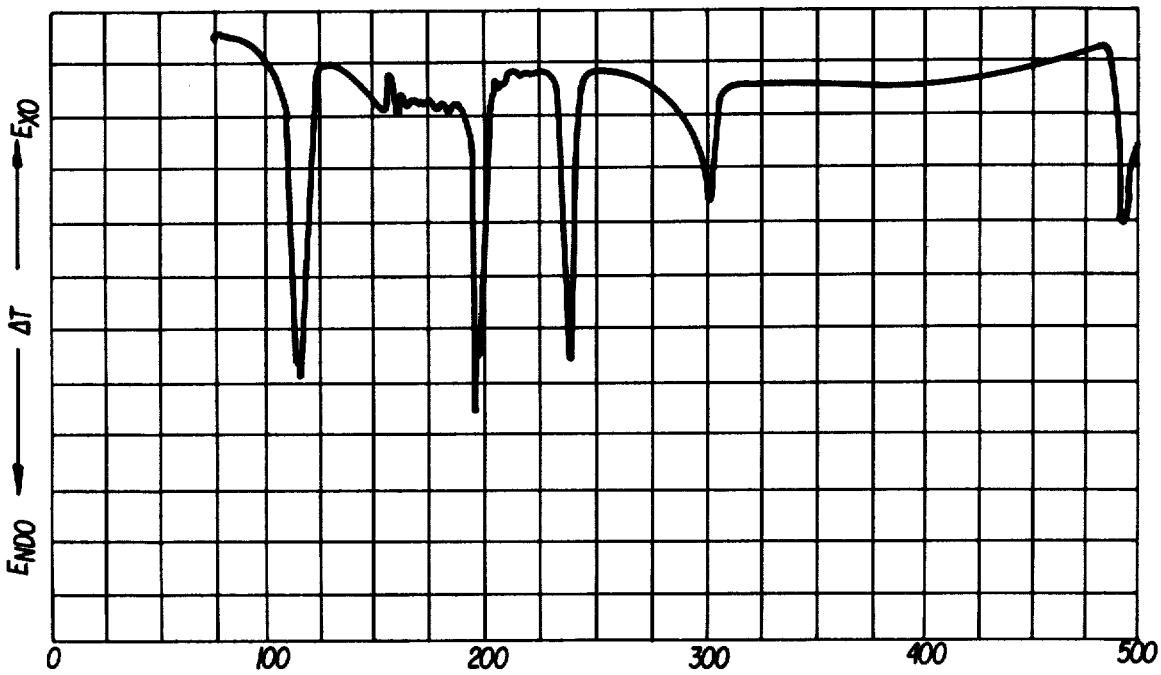
Figure 2:
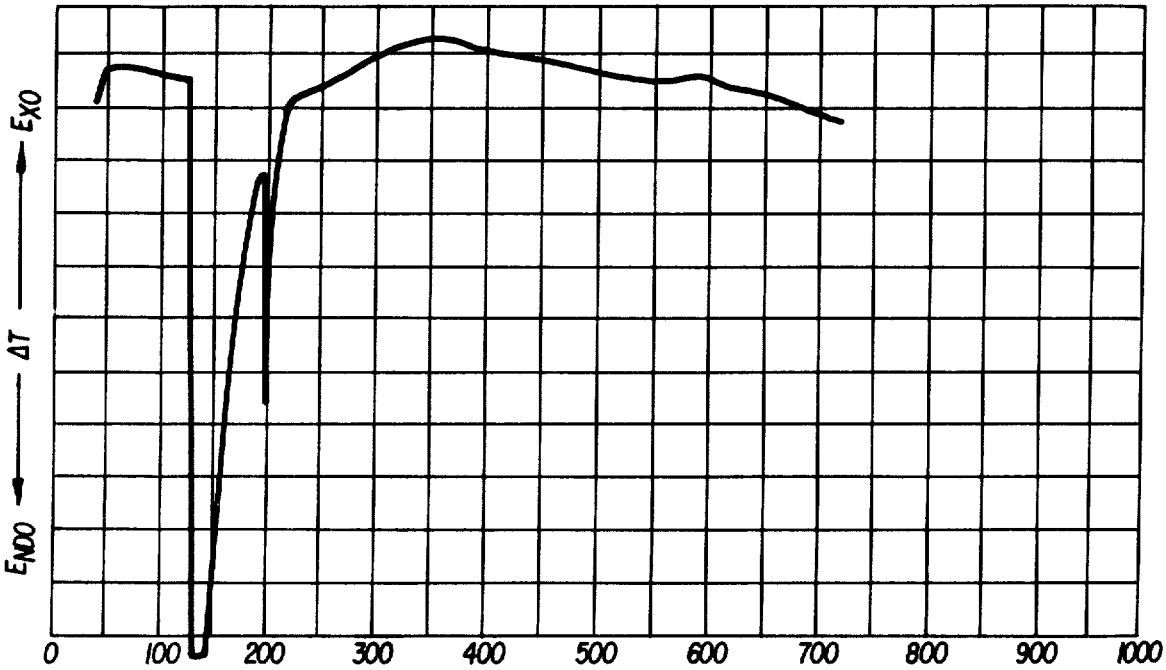

The multi-endothermic salts contemplated for use in the present invention can be added in the aforedescribed amounts to the total cigarette blend or its individual components. Preferably these salts are added to the fastest burning components of the cigarette tobacco blend, generally, reconstituted tobacco or burley tobacco. The effect of reducing blend burn rate is larger when the treatment is applied to these faster burning components. A preferred embodiment of the present invention involves the use of natural tobacco blends containing from about 15 percent to a maximum of about 30 percent by weight of the total blend of at least one tobacco selected from the group of burley and reconstituted tobaccos. Most preferably the invention contemplates the application of hydrated magnesium chloride to the reconstituted portion of a blend of natural cigarette smoking tobaccos wherein said reconstituted tobacco is present in an amount of from about 15 percent to a maximum of about 30 percent by weight of the total blend.

While burley and reconstituted tobaccos are the fastest burning components of cigarette smoking tobacco compositions the remaining slower burning portions of the blend generally comprise the various varieties of Virginia, Maryland and Oriental tobaccos.

The invention is illustrated more explicitly by the following examples. The reconstituted tobacco portion of a typical filter cigarette blend was sprayed with a solution of $MgCl_2.6H_2O$ in an amount such that in the total blend the level of magnesium chloride, as $MgCl_2$, was 0.67%, 0.90% and 1.64% of the weight of the tobacco at equilibrium moisture plus the magnesium chloride. The reconstituted tobacco containing the magnesium chloride additive was commingled with the other tobacco components of the blend so as to be distributed substantially uniformly therewith. The blend was made into 85 mm cigarettes with 20 mm cellulose acetate filters using an intermediate porosity paper (Greiner 20 sec.) and the cigarettes were smoked according to standard analytical procedures wherein the cigarettes were smoked with 35 cc, 2 second puffs taken once a minute to a butt length of tipping plus 3 mm. The burn rate and the analytical data for the cigarettes tested are summarized in Table 1. In this and in succeeding tables LBR abbreviates linear burn rate, MBR abbreviates mass burn rate, NFDS abbreviates nicotine-free dry solids, HCN abbreviates hydrocyanic acid, Ald abbreviates total aldehydes expressed as equivalent ug of acetaldehyde (Ref. P. F. Collins, N. M. Sarji and J. F. Williams, *Beiträge zur Tabakforschung*, 7, 73–78 (1973), and μg stands for microgram:

TABLE I

| | | | | |
|---|---|---|---|---|
| $MgCl_2$ (%) | 0 | 0.67 | 0.90 | 1.64 |
| # Puffs | 8.0 | 8.3 | 8.3 | 8.9 |
| LBR | 5.49 | 5.30 | 5.26 | 4.85 |
| MBR | 64.7 | 63.9 | 62.6 | 57.6 |
| Yields/cig | | | | |
| Nic (mg) | 1.15 | 1.17 | 1.10 | 1.14 |
| NFDS (mg) | 15.5 | 15.5 | 15.9 | 16.9 |
| Yields/puff | | | | |
| HCN (μg) | 26 | 29.2 | 30.4 | 31.7 |
| Tot. Ald. (μg) | 152 | 142 | 141 | 116 |
| pH of smoke | 6.00 | 5.90 | 5.90 | 5.90 |

The data in the foregoing table demonstrate that at each level of magnesium chloride there was a marked decrease in burn rate, whether in terms of puff number, linear burn rate or mass burn rate. There were marginal decreases in smoke pH and total aldehydes and increases in nicotine-free dry solids (NFDS) and HCN, although the changes were beyond experimental error only for the highest level of the additive.

Additional burn rate tests were made with 85 mm cigarettes with 20 mm cellulose acetate filters which had been fabricated from a different filter blend of tobacco components and where the levels of hydrated magnesium chloride additive were different from the levels employed in connection with the test summarized in Table I. Hydrated magnesium chloride was again applied to the reconstituted tobacco portion of the blend. The cigarettes were made with two types of paper, namely, an intermediate porosity paper (Greiner 20 sec.) and a porous paper (Greiner 12 sec.). The cigarettes were smoked according to the aforesaid standard analytical procedures and the test results are summarized in Tables II and III which follow:

TABLE II

| Intermediate porosity paper | | | | |
|---|---|---|---|---|
| $MgCl_2$ (%) | — | 0.36 | 0.85 | 0.95 |
| $Ca(OH)_2$ (%) | — | — | — | 0.75 |
| # Puffs | 7.7 | 7.9 | 8.2 | 8.0 |
| LBR (mm/min) | 5.52 | 5.33 | 5.16 | 5.28 |
| MBR (mg/min) | 61.8 | 60.3 | 57.8 | 58.4 |
| Yields/cig | | | | |
| Nic (mg) | 1.11 | 1.31 | 1.28 | 1.11 |
| NFDS (mg) | 17.4 | 18.1 | 18.6 | 16.8 |
| Yields/puff | | | | |
| HCN (μg) | 32.5 | 33.6 | 35.9 | 31.1 |
| Tot. Ald. (μg) | 159 | 153 | 134 | 138 |
| pH of Smoke | 5.86 | 5.97 | 5.83 | 6.20 |

TABLE III

| Porous Paper | | | | |
|---|---|---|---|---|
| # Puffs | 7.3 | 7.6 | 7.8 | 7.7 |
| LBR | 6.29 | 6.03 | 5.62 | 5.69 |
| MBR | 70.6 | 67.2 | 63.1 | 63.3 |
| Yields/cig | | | | |
| Nic. (mg) | 0.98 | 1.10 | 1.13 | 1.02 |
| NFDS (mg) | 15.3 | 16.2 | 16.2 | 15.7 |

TABLE III-continued

| Porous Paper | | | | |
|---|---|---|---|---|
| Yields/puff | | | | |
| HCN (μg) | 31.2 | 31.7 | 35.4 | 32.5 |
| Tot. Ald. (μg) | 158 | 152 | 138 | 152 |
| pH of Smoke | 5.84 | 5.94 | 5.87 | 6.26 |

Tables II and III again demonstrated the marked decrease in burn rate with increasing levels of the hydrated magnesium chloride additive. The yields of smoke components again exhibited marginal changes as in Table I, except that nicotine now also showed an increase and smoke pH did not reflect an additive effect.

As is evident from the foregoing data, the presence of the magnesium chloride additive tends in some cases to have an effect on smoke component yields. Although the changes are very modest, of the order of the experimental error in the analytical procedure employed, and thus are not of much practical significance, further experimental work showed that the variations in smoke components could be negated by the addition of alkaline materials, such as calcium hydroxide, to the total tobacco blend to increase the pH of the tobacco materials. Any physiologically acceptable alkaline material, including magnesium hydroxide, basic phosphates and the like, can be employed. Calcium hydroxide is preferred because calcium hydroxide does not introduce new elements into the tobacco product. The amount of alkaline material sufficient for this purpose is in the range of about 0.1 to about 2 weight percent, and preferably is from about 0.5 to about 1 percent.

Table IV, which follows, illustrates the use of various salts which exhibit analogous endothermic phenomena and in each case the burn rate of the cigarette tobacco blend was substantially reduced. In each instance the blend that was used was similar to that used in the tests hereinabove mentioned and by application of the additive in the form of an aqueous solution to the reconstituted tobacco component of the blend.

TABLE IV

| Summary of Data for Various Additives | | | | |
|---|---|---|---|---|
| Additive | Level (%) | # Puffs | LBR (mm/min) | MBR (mg/min) |
| Control | 0 | 8.3 | 5.18 | 64.5 |
| $FeNH_4Cit$ | 0.81 | 8.4 | 4.95 | 61.9 |
| $FeCl_2 . 6H_2O$ | 2.11 | 9.1 | 4.48 | 55.8 |
| $Fe_2(SO_4) . 9H_2O$ | 2.43 | 8.5 | 4.98 | 62.8 |
| MgHCit | 1.67 | 8.3 | 5.03 | 62.2 |
| $Na_3Cit . 2H_2O$ | 2.04 | 8.7 | 4.87 | 61.7 |
| Control | 0 | 8.1 | 5.24 | 61.6 |
| $KAl(SO_4)_2 . 12H_2O$ | 1.43 | 8.3 | 5.04 | 60.1 |

In the foregoing table "Cit" specifies—citrate—.

We claim:

1. A smoking tobacco composition consisting essentially of a blend of natural cigarette smoking tobaccos, said blend containing from about 15 percent to a maximum of 30 percent by weight of a tobacco selected from the group of reconstituted and burley tobaccos, wherein said reconstituted and burley tobaccos are the fastest burning component of the blend said fast burning tobacco having deposited thereon a salt, which when heated from ambient to burning temperature exhibits a plurality of endothermic reactions at successively increasing temperatures in the range of from 100° C. to 500° C., selected from the group consisting of $MgCl_2.6H_2O$, $FeNH_4Cit$, $FeCl_3.6H_2O$, $Fe(SO_4).9H_2O$, MgHCit, $Na_3Cit.2H_2O$, and KAL $(SO_4)_2.12H_2O$ said salt being deposited on said fast burning tobacco in an amount of from about 0.1 percent to about 5.0 percent by weight of the combined anhydrous weight of said tobacco blend and said salt.

2. The smoking tobacco composition according to claim 1 wherein the salt is $MgCl_2.6H_2O$.

3. The smoking tobacco composition of claim 1 wherein the salt is present in an amount of from about 0.75% to about 1.5% of the combined weight of said tobacco and said salt.

4. The smoking tobacco composition of claim 3 wherein the salt is $MgCl_2.6H_2O$.

5. The smoking tobacco according to claim 1 wherein said smoking tobacco contains a physiologically acceptable alkaline material in an amount effective to increase the pH of the tobacco smoke and substantially restore the yields of the smoke components to the level found in smoke produced from the tobacco in the absence of said salt and said alkaline material.

6. The smoking tobacco in accordance with claim 5 wherein said alkaline material is calcium hydroxide in an amount of from about 0.1 to about 2 weight percent.

7. A cigarette comprised of a tobacco column which contains a blend of natural smoking tobaccos containing from about 15 to a maximum of about 30 percent by weight of a tobacco selected from the group of reconstituted tobacco or burley tobacco wherein said reconstituted and burley tobaccos are the fastest burning component of the blend, said fast burning tobacco having deposited thereon hydrated magnesium chloride in an amount of from about 0.1 percent to about 5.0 percent of the combined anhydrous weight of said hydrated magnesium chloride and said tobacco.

8. The smoking tobacco according to claim 7 which contains calcium hydroxide in an amount of from about 0.5 to about 1 weight percent.

9. The cigarette according to claim 7 wherein the weight of said hydrated magnesium chloride as $MgCl_2$ is from about 0.75 to about 1.5% of the combined weight of said magnesium chloride and the tobacco content of the cigarette.

10. A method for decreasing the burn rate of a blend of natural smoking tobaccos, which blend contains from about 15 percent up to a maximum of about 30 percent by weight of a tobacco selected from the group of reconstituted and burley tobaccos wherein said reconstituted and burley tobaccos are the fastest burning components of the blend, which method comprises depositing on said fast burning tobacco a salt selected from the group consisting essentially of $MgCl_2.6H_2O$, $FeNH_4Cit$, $FeCl_3.6H_2O$, $Fe(SO_4).9H_2O$, MgHCit, $Na_3Cit.2H_2O$, and KAL $(SO_4)_2.12H_2O$ in an amount sufficient to provide a concentration of salt of from about 0.1 percent to about 5.0 percent by weight of the combined anhydrous weight of said tobacco blend and said salt.

11. The smoking tobacco composition of claim 10 wherein the salt is present in an amount of from about 0.75% to about 1.5% of the combined weight of said tobacco blend and said salt.

12. The smoking composition of claim 11 wherein the salt is $MgCl_2.6H_2O$.

13. The method of claim 10 which further comprises the addition of a physiologically acceptable alkaline material in an amount sufficient to increase the pH of the tobacco smoke and substantially restore the yields of smoke components to the level found in smoke produced from the tobacco in the absence of said salt and said alkaline material.

14. The method according to claim 13 wherein said alkaline material is calcium hydroxide in an amount of from about 0.1 to about 2 weight percent.

15. The method according to claim 10 wherein the fast burning component of the blend is a reconstituted tobacco.

* * * * *